United States Patent [19]

Bridgnell

[11] 4,291,752

[45] Sep. 29, 1981

[54] HEAT EXCHANGER CORE ATTACHMENT AND SEALING APPARATUS AND METHOD

[76] Inventor: David G. Bridgnell, 26963 Bolan La., Rolling Hills, Calif. 90274

[21] Appl. No.: 955,118

[22] Filed: Oct. 26, 1978

[51] Int. Cl.[3] ..... F28F 5/00

[52] U.S. Cl. ..... 165/81; 165/78; 165/83; 110/304

[58] Field of Search ..... 165/78, 81, 83, 142, 165/103, 158; 110/304; 122/459

[56] References Cited

U.S. PATENT DOCUMENTS

| | | | |
|---|---|---|---|
| 2,416,674 | 3/1947 | Bailey | 165/81 |
| 3,078,919 | 2/1963 | Brown | 165/81 |
| 3,398,787 | 8/1968 | Bevevino | 165/81 |
| 3,547,202 | 12/1970 | Tickner | 165/81 |
| 3,960,210 | 6/1976 | Chartet | 165/149 |
| 4,113,007 | 9/1978 | Flower et al. | 165/81 |

*Primary Examiner*—George T. Hall

[57] ABSTRACT

A combination structure interconnecting and sealing means for joining an air duct with the end plate of a heat exchanger core to allow for variations in spatial dimensions resulting from thermal expansion. The coupling arrangement comprises a circumferential flange attached, as by welding, to the circular duct. The periphery of the flange is provided with radial slots which are engaged underneath T-shaped clips attached to the heat exchanger plate. Within the circumference of the flange and generally in line with the duct and associated manifold section of the end plate is a U-shaped bladder member extending entirely around the joint and welded to provide a seal between the end of the duct and the plate. Similar bladder members are provided between adjacent units making up an overall heat exchanger core.

13 Claims, 7 Drawing Figures

HEAT EXCHANGER CORE ATTACHMENT AND SEALING APPARATUS AND METHOD

INTRODUCTION

Heat exchangers incorporating apparatus of the present invention have been developed for use with large gas turbines for improving their efficiency and performance while reducing operating costs. Heat exchangers of the type under discussion are sometimes referred to as recuperators, but are more generally known as regenerators. A particular application of such units is in conjunction with gas turbines employed in gas pipe line compressor drive systems.

Several hundred regenerated gas turbines have been installed in such applications over the past twenty years or so. Most of the regenerators in these units have been limited to operating temperatures not in excess of 1000° F. by virtue of the materials employed in their fabrication. Such regenerators are of the plate-and-fin type of construction incorporated in a compression-fin design intended for continuous operation. However, rising fuel costs in recent years have dictated high thermal efficiency, and new operating methods require a regenerator that will operate more efficiently at higher temperatures and possesses the capability of withstanding thousands of starting and stopping cycles without leakage or excessive maintenance costs. A stainless steel plate-and-fin regenerator design has been developed which is capable of withstanding temperatures of 1100° or 1200° F. under operating conditions involving repeated, undelayed starting and stopping cycles.

The previously used compression-fin design developed unbalanced internal pressure-area forces of substantial magnitude, conventionally exceeding one million pounds in a regenerator of suitable size. Such unbalanced forces tending to split the regenerator core structure apart are contained by an exterior frame known as a structural or pressurized strongback. By contrast, the modern tension-braze design is constructed so that the internal pressure forces are balanced and the need for a strongback is eliminated. However, since the strongback structure is eliminated as a result of the balancing of the internal pressure forces, the changes in dimension of the overall unit due to thermal expansion and contraction become significant. Thermal growth must be accommodated and the problem is exaggerated by the fact that the regenerator must withstand a lifetime of thousands of heating and cooling cycles under the current operating mode of the associated gas turbine engine which is started and stopped repeatedly.

Confinement of the extreme high temperatures in excess of 1000° F. to the actual regenerator core and the thermal and dimensional isolation of the core from the associated casing and support structure, thereby minimizing the need for more expensive materials in order to keep the cost of the modern design heat exchangers comparable to that of the plate-type heat exchangers previously in use, have militated toward various mounting, coupling and support arrangements which together make feasible the incorporation of a tension-braze regenerator core in a practical heat exchanger of the type described.

Heat exchangers of the type generally discussed herein are described in an article by K. O. Parker entitled "Plate Regenerator Boosts Thermal and Cycling Efficiency", published in *The Oil & Gas Journal* for Apr. 11, 1977.

BACKGROUND OF THE INVENTION

1. Field of the Invention

This invention relates in general to heat exchangers and, more particularly, to particular arrangements for coupling between heat exchanger sections and between such sections and associated duct work.

2. Description of the Prior Art

Various arrangements are known in the prior art for accommodating different degrees of thermal growth between adjacent members which are to be sealed or otherwise joined together. The Bevino U.S. Pat. No. 3,398,787 discloses an expansion joint for a shell and tube type heat exchanger for accommodating displacement of one tube sheet relative to the shell, which displacement results from the temperature differences between the fluid within the tubes and the fluid within the shell surrounding the tubes. The attemperator of the Bailey U.S. Pat. No. 2,416,674 incorporates U-shaped sealing rings between inner and outer tubes for permitting radial expansion or contraction with changes in temperature. The Ticknor U.S. Pat. No. 3,547,202 discloses a mounting arrangement including bellows and a plurality of hook elements for supporting a pair of coaxial tubes with respect to each other, which tubes are subjected to different gas temperatures in a flue or exhaust gas recuperator. The Chartet U.S. Pat. No. 3,960,210 discloses a U-shaped fold connected by lugs to the flanges of the heat exchanger during the assembly step in preparation for brazing the core. J. W. Brown, Jr. in U.S. Pat. No. 3,078,919 discloses a recuperator having T-shaped retainers which are movable in longitudinal slots to provide slidable support of disparate structural members operating at different temperatures. The Italian Pat. No. 311,249, Swedish Pat. No. 178,363 and British Pat. No. 1,454,260 show various configurations of seals and flexible mounting configurations for pressurized, thermal variant bodies. However, none of the disclosed arrangements incorporate a combined mounting and sealing structure for coupling a duct to a heat exchanger core plate of the type described herein, nor a bladder type seal for mounting between adjacent sections of a multi-unit heat exchanger core.

SUMMARY OF THE INVENTION

In brief, arrangements in accordance with the present invention comprise a coupling arrangement for mounting between adjacent elements in the regenerator which are subject to relative dimensional changes due to thermal deformation.

In one arrangement in accordance with the present invention, an attachment is provided between a heat exchanger core end plate and an associated duct for transferring high pressure air between the duct and the heat exchanger core. In this arrangement, a circumferential bladder or diaphragm of U-shaped cross-section is joined between the end of the duct and a portion of the plate constituting a manifold section in sealing arrangement. During operation, the duct is at one temperature and the heat exchanger core is at another temperature. The end portion of the duct is provided with a circumferential, cone-shaped flange having a plurality of radial slots about its periphery. The flange at these radial slots engages a corresponding plurality of T-shaped clips which are mounted on the heat exchanger end plate. By virtue of this arrangement, a pressure tight seal is effected by the circumferential U-shaped bladder which accommodates radial movement between the duct and the heat exchanger resulting from thermal growth of the heat exchanger while the fastening of the flange accommodates radial deformation and limited displacement and at the same time transmits controlled duct coupling loads to the core.

In another arrangement in accordance with the invention, a similar U-shaped bladder is mounted circumferentially between adjacent sections of the heat exchanger core. The core is made up of a plurality of units or sections in order to limit the extent of cumulative thermal growth. Expansion of one unit relative to next is then absorbed by longitudinal or axial movement in the bladder seal positioned between adjacent core sections.

Arrangements in accordance with the present invention thus allow heat exchanger thermal deformation without radial and axial constraint, either from one core section to the next or between the heat exchanger end section and the attached compressed air duct.

BRIEF DESCRIPTION OF THE DRAWING

A better understanding of the present invention may be had from a consideration of the following detailed description, taken in conjunction with the accompanying drawings in which.

DESCRIPTION OF THE PREFERRED EMBODIMENTS

Figure 1:
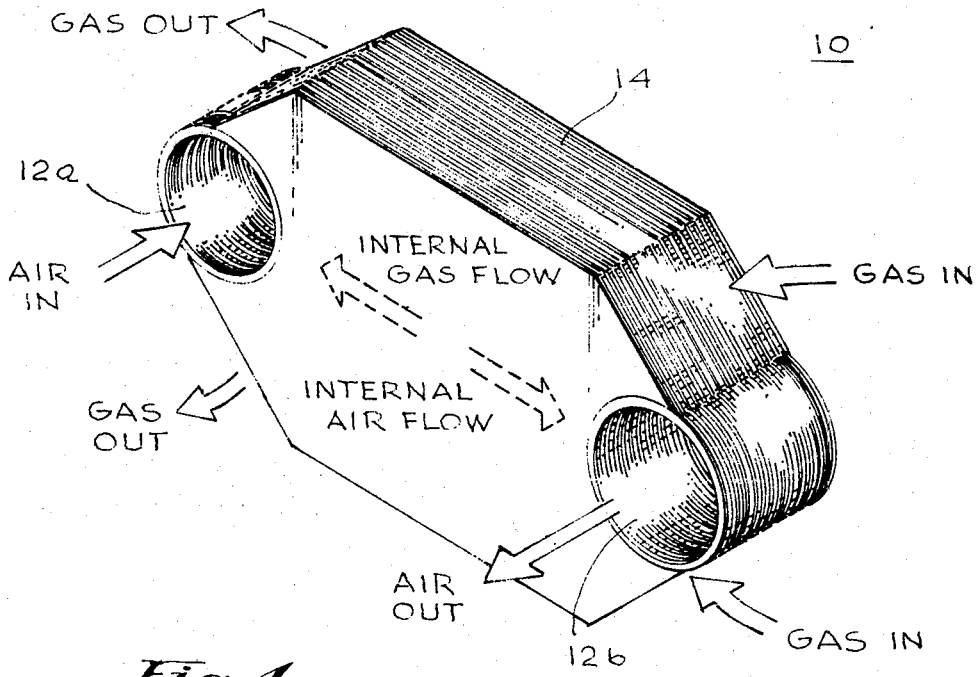
FIG. 1 is a perspective view of a heat exchanger core section in which the present invention is utilized.

FIG. 1 illustrates a brazed regenerator core as utilized in heat exchangers of the type discussed hereinabove. The unit 10 of FIG. 1 is but one section of a plurality (for example, six) designed to be assembled in a module such as the module 20 of FIG. 2. As shown in FIG. 1, the core section 10 comprises a plurality of formed plates interleaved with fins which serve to direct the air and exhaust gas in alternating adjacent cross-flow passages for maximum heat transfer. When assembled and brazed to form an integral unit, the formed plates define respective manifold passages 12*a* and 12*b* at opposite ends of the central counterflow, heat exchanging section 14. As indicated by the respective arrows in FIG. 1, heated exhaust gas from an associated turbine enters at the far end of the section 10, flowing around the manifold passage 12*b*, then through the gas flow passages in the central section 14 and out of the section 10 on the near side of FIG. 1, flowing around the manifold 12*a*. At the same time, compressed air from the compressor driven by the associated turbine enters the heat exchanger section through the manifold 12*a*, flows through internal air flow passages connected with the manifolds 12*a*, 12*b* through the central, heat exchanging section 14, and then flows out of the manifold 12*b*. In the process, the exhaust gas gives up substantial heat to the compressed air which is fed to the associated turbine, thereby considerably improving the efficiency of operation of the regenerated turbine system.

Figure 2:
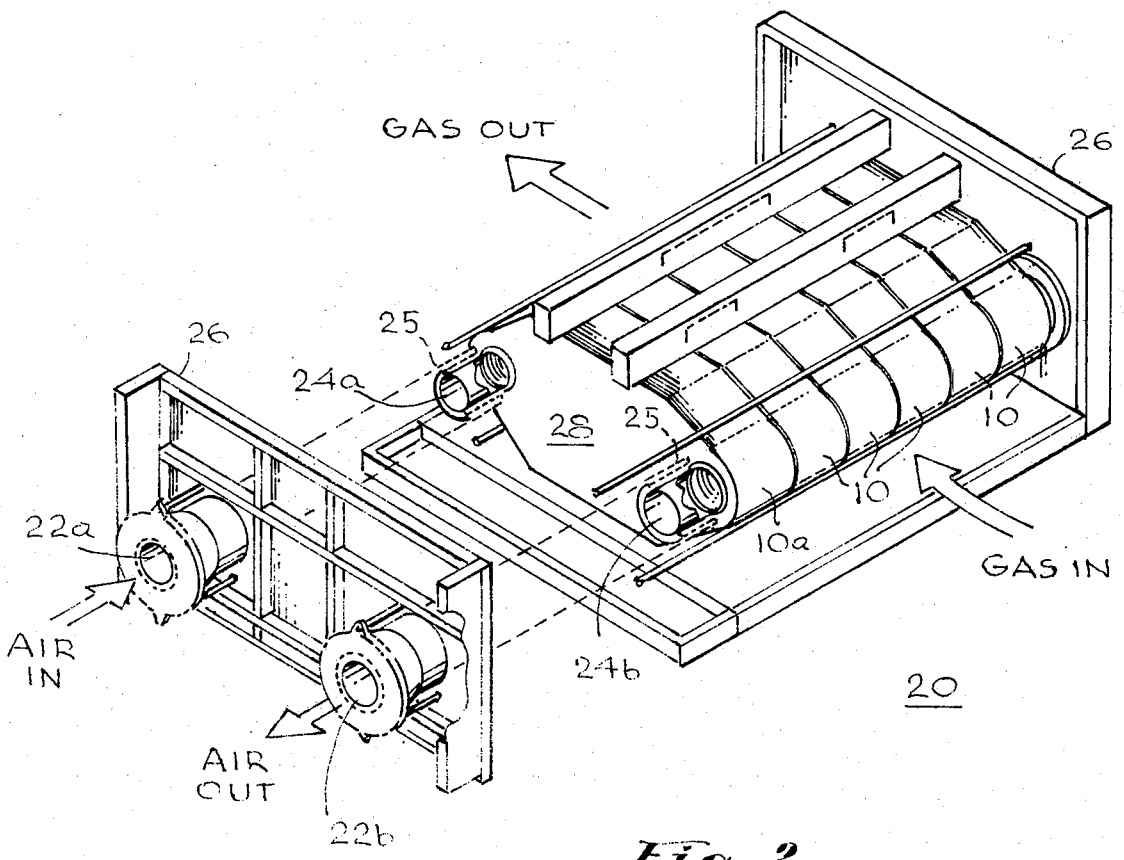
FIG. 2 is a perspective, partially exploded view of a heat exchanger module comprising several of the sections of FIG. 1.

The illustration of FIG. 2 shows six such sections 10, (a "six-pack") assembled with associated hardware in a single heat exchanger module 20. These modules can in turn be combined in parallel operation to satisfy the regenerating requirements of the gas turbines over a considerable range of sizes and power ratings. Such systems are presently providing regeneration for gas turbines in the range of 5000 to 100,000 hp.

In the operation of a typical system employing a regenerator of the type discussed herein, ambient air enters through an inlet filter and is compressed to about 100 to 150 psi, reaching a temperature of 500° to 600° F. in the compressor section of the gas turbine. It is then piped to the regenerator, entering through the inlet flange 22*a* (FIG. 2) and inlet duct 24*a*. In the regenerator module 20, the air is heated to about 900° F. The heated air is then returned via outlet duct 24*b* and outlet flange 22*b* to the combustor and turbine section of the associated engine via suitable piping. The exhaust gas from the turbine may be at approximately 1100° F. and is at essentially ambient pressure. This gas is ducted through the regenerator 20 as indicated by the arrows labelled "gas in" and "gas out" (ducting not shown) where the waste heat of the exhaust is transferred to heat the air, as described. Exhaust gas drops in temperature to about 600° F. in passing through the regenerator 20 and is then discharged to ambient through an exhaust stack. In effect, the heat that would otherwise be lost is transferred to the air, thereby decreasing the amount of fuel that must be consumed to operate the turbine. For a 30,000 hp turbine, the regenerator heats 10 million pounds of air per day.

The regenerator is designed to operate for 120,000 hours and 5000 cycles without scheduled repairs, a lifetime of 15 to 20 years in conventional operation. This requires a capability of the equipment to operate at gas turbine exhaust temperatures of 1100° F. and to start as fast as the associated gas turbine so there is no requirement for wasting fuel to bring the system on line at stabilized operating temperatures. The use of the thin formed plates, fins and other components making up the brazed regenerator core sections contribute to this capability. However, it will be appreciated that there is substantial thermal growth in all three dimensions as a result of the extreme temperature range of operation and the substantial size of the heat exchanger units. As an example, the overall dimensions for the module shown in FIG. 2, in one instance, were 17 feet in width, 12 feet in length (the direction of gas flow) and 7.5 feet in height. The core section shown in FIG. 1 is approximately 2 feet in width (the minimum dimension). Construction of the module 20 of a plurality of sections 10 affords a limitation on the cumulative thermal growth of the manifold portions in the width dimension.

A single section 10 expands in all three dimensions as it is heated. These changes of direction of the core must be accommodated with respect to the frame 26, which is a rigid structure. Whenever the core sections are joined to each other or to associated ducting, seals are required for the air passages which, as shown, extend transversely of the core plates.

Figure 3:
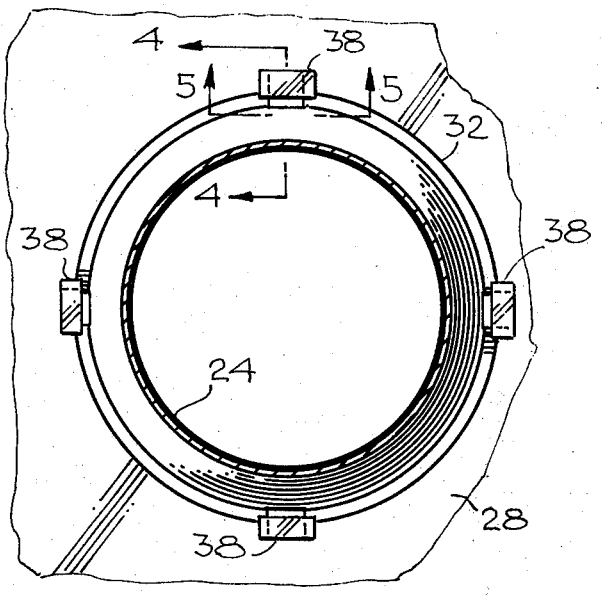
FIG. 3 is a view in partial section of a portion of the module of FIG. 2 illustrating the duct flange retainer arrangement of the present invention.
Figure 4:
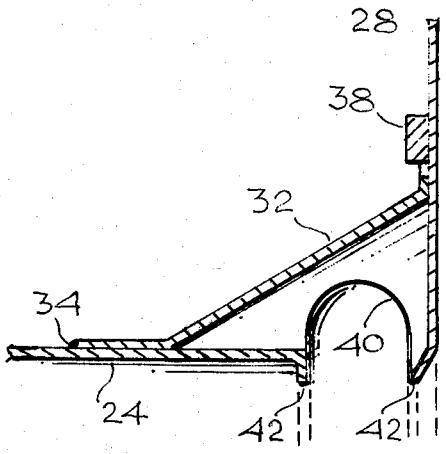
FIG. 4 is a sectional view of a portion of the arrangement of FIG. 3, taken along the lines 4—4.
Figure 5:
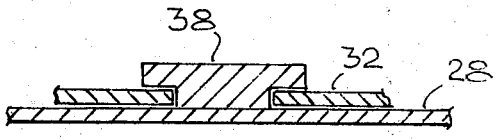
FIG. 5 is a sectional viw taken along the lines 5—5 of FIG. 3.

FIGS. 3–5 illustrate particular arrangements in accordance with the present invention for coupling between the ducts 24*a*, 24*b* (FIG. 2) and the end plate 28 of the core section 10*a*. Similar arrangements are employed for coupling the blind ducts at the opposite end of the module 20 which are equipped with manhole covers to permit ready access to the core for inspection, maintenance, and the like.

In FIGS. 3–5, a duct 24 is shown equipped with a duct flange 32, which is attached, as by welding or brazing, at 34. At the peripheral face of the flange 32, there are a plurality of radially aligned slots such as 36 which permit engagement of the flange by corresponding T-shaped clips 38, attached as by welding to the heat exchanger end plate 28. Associated with this coupling, as shown in FIG. 4, is a flexible bladder seal 40 which is attached, as by welding, at 42 to the adjacent end of the duct 24 and the edge of the heat exchanger end plate 28 which defines the opening of the manifold 12. The sealing member 40 is a circumferential U-shaped bladder or diaphragm extending completely around the air passage comprising the juncture of the duct 24 and the manifold 12 and serves to provide a fluid tight seal at this juncture. The seal 40 of FIG. 4 permits relative variation in dimension between the portions which it joins—the end of the duct 24 and the manifold section of the end plate 28—thus eliminating structural failures which would result from a rigid connection. At the same time, the attachment means comprising the clips 38 and the duct flange 32 permit relative movement in a radial direction resulting from differences in thermal growth between the duct 24 and the end plate 28 while at the same time serving to transmit end loading and torque loading between the duct and the end plate. It will be noted from FIG. 2 that the ducts 24 are provided with bellows sections 25 to accommodate relative thermal growth of the core with respect to the outer casing and to control the duct loads applied to the core. This allows a rigid coupling to be effected at the duct flanges 22.

As indicated in FIG. 5, the underside of the T-shaped clip 38 is spaced just slightly apart from the adjacent surfaces of the duct flange 32. This spacing may be approximately 0.002 or 0.003 inches and is sufficient to accommodate radial displacement of the flange 32 relative to the core end plate 28 while transmitting axial loads between the duct and the core.

Figure 6:
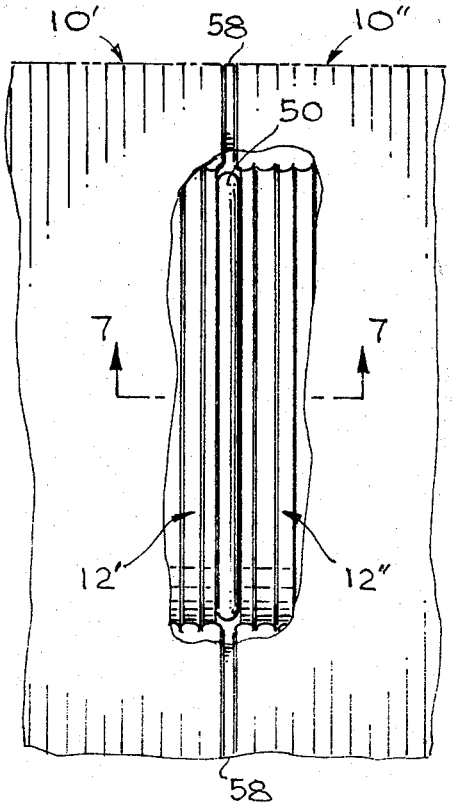
FIG. 6 is a view, partially broken away, of a portion of the module of FIG. 2 illustrating an inter-unit seal of the present invention.
Figure 7:
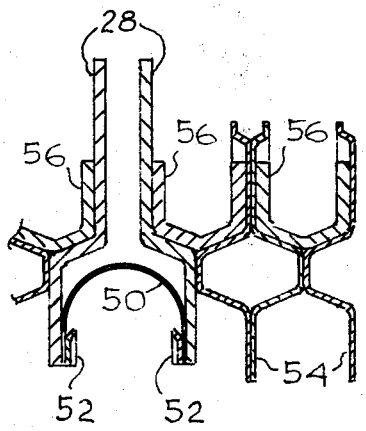
FIG. 7 is a sectional view, taken along the line 7—7 of FIG. 6.

FIGS. 6 and 7 illustrate the use of a sealing member 50 between the manifold portions of adjacent core sections of the heat exchanger. In FIG. 6 the core sections are designated 10′ and 10″ and, in the broken away portion, the manifold portions 12′ and 12″ are represented. The seal 50, a circumferential U-shaped bladder or diaphragm, preferably of stainless steel similar to the seal 40 of FIG. 4, is secured, as by welding, at the ends thereof to the end plates of the core sections 10′, 10″ at the peripheries of the respective manifold 12′, 12″ terminal portions. Reinforcing discs 52 are included as part of the welded connection. These are circumferential members extending about the manifold opening within the bladder of seal 50. FIG. 7 also shows in particular detail portions of the inner tube plates 54 having openings defining the manifold 12 with exterior reinforcing members 56 which provide reinforcement for the tube plate brazed joints about the manifold opening. Spacing bars 58 (FIG. 6) are brazed between adjacent core sections 12′, 12″ except at the ends of the heat exchanger core where the manifold portions are located. These bars 58 serve to tie adjacent core sections together to ensure that lateral growth is substantially uniform in all of the sections making up a given core module. However, the manifold portions of the heat exchanger are not so constrained; therefore, by flexing, the manifold portions are enabled to experience axial thermal growth which is limited to a single core section and not transmitted to the next. Because of different temperatures which may occur in the manifold portions relative to the remainder of the core, particularly during the transitional phases encountered during start-up and shutdown of the system, the differences in thermal growth would result in severe distortion of the core if the core were not divided into sections. Such differences in axial thermal growth of the manifold portions are accommodated by the flexible bladder seals such as 50 which are welded between adjacent core sections. The seal 50 serves the same function as described for the seal 40 of FIG. 4; it permits relative axial or longitudinal movement between the adjacent end plates of the core sections 10′, 10″ while effecting a pressure tight seal from one manifold portion 12′ to the next 12″. However, the specific purpose is different, since the need for the expandable seal 50 at this point is to permit the overall module 20 (FIG. 2) to be made up of a series of individual sections such as the core section 10 of FIG. 1. By sectioning the overall core in this manner, the degree of cumulative thermal growth in the major dimension of the module is limited and maintained within tolerable limits. Thus, any growth of the core section manifold 12′ is not transmitted to the core section 12″ (and vice versa) but is absorbed by the flexible U-shaped seal member 50 between the core section manifold portions.

By virtue of the arrangements in accordance with the present invention as described hereinabove, suitable connections and couplings are developed between adjacent structural sections which, in operation of the overall system, encounter changes in dimension which differ from one element to the next. In the case of the duct-to-duct core coupling of FIGS. 3–5, the duct and heat exchanger stresses resulting from the attachment become negligible, while at the same time the desired fluidtight seal at the interface between the duct and the heat exchanger is established. In the example of FIGS. 6 and 7, the considerable thermal growth of the manifold portions of the adjacent core sections 10 is absorbed, one with respect to the other, by the seals 50.

Although there have been described above specific arrangements of a heat exchanger duct attachment and sealing apparatus and method in accordance with the present invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Heat exchanger coupling apparatus comprising:

first and second air passage defining members of thin sheet material, the members being adjacent one another but displaced therefrom and subject to disparate dimensional changes resulting from thermal growth;

a sealing member comprising a U-shaped circumferential metal bladder extending between said first and second members; and means affixing the opposed ends of the sealing member in sealing relationship to respective adjacent edges of said first and second members.

2. The apparatus of claim 1 wherein said first member comprises the end plate of a heat exchanger core section defining an air manifold and the second member comprises an air duct for connection to said manifold, and wherein said circumferential bladder extends around corresponding openings in said duct and said heat exchanger plate and is welded to the duct and the plate.

3. The apparatus of claim 2 further comprising an offset flange attached to said duct and a plurality of clips mounted selectively about the circumference of said flange and affixed to said heat exchanger plate for securing said flange to said plate.

4. The apparatus of claim 3 wherein said clips are T-shaped in cross-section and said flange is provided with radially extending slots for straddling the base portion of the clip in engaging relationship between the plate and the portion of the clip remote therefrom, said slots being shaped to accommodate radial movement of the flange relative to the clip.

5. The apparatus of claim 4 wherein the flange comprises a major portion angled relative to the duct and affixed thereto at one end of the major portion, and further includes a base portion extending outwardly and generally parallel to said plate, said base portion containing said radially extending slots.

6. The apparatus of any one of claims 1–5 further comprising a heat exchanger core made up of a plurality of core sections spaced from each other and having aligned air manifold portions in opposite ends thereof; and a plurality of additional sealing members each comprising a U-shaped circumferential metal bladder extending between adjacent core sections and surrounding the manifold portions thereof, each additional sealing member being affixed to adjacent end plates of adjacent core sections.

7. The apparatus of claim 1 wherein the first and second members comprise adjacent end plates of respective heat exchanger core sections next to one another and wherein the circumferential bladder has opposed ends attached respectively to said end plates about manifold openings therein for coupling manifolds of said core sections together in sealing relationship.

8. The apparatus of claim 7 wherein said U-shaped bladder is configured with the open end of the U-shaped cross-section facing radially inward.

9. The apparatus of claim 7 wherein the ends of the bladder element are affixed by welding to the adjacent core section end plates.

10. The apparatus of any one of claims 7–9 further including an air duct for connection to the manifold opening of an end plate, an additional U-shaped circumferential metal bladder extending in sealing relationship between the air duct and the adjacent end plate about a manifold opening, and further comprising an offset flange attached to said duct and a plurality of clips mounted selectively about the circumference of said flange and affixed to said heat exchanger end plate for securing the flange to the plate.

11. The method of limiting accumulated thermal growth along a plate-type heat exchanger in a direction orthogonal to the plane of the plates comprising the steps of:

dividing the heat exchanger into sections of limited dimension along said direction;

assembling a plurality of such sections in side-by-side relationship;

spacing adjacent sections by a selected distance from each other; and joining together in sealed relationship corresponding openings of adjacent sections by attaching a circumferential bladder member of U-shaped cross-section to adjacent mounting elements of said sections defining said openings.

12. The method of joining the manifold of a heat exchanger core section to an adjacent air passage, which heat exchanger core section and adjacent passage are subject to relative variations in the dimensional spacing therebetween due to differences in temperature of operation thereof comprising the steps of:

affixing a flexible sealing member at the opposite ends thereof to the heat exchanger core section and the passage, respectively, attaching an extended circumferential flange to said passage on one side of said sealing member; and securing said flange in sliding relationship to said heat exchanger core section on the opposite side of said sealing member.

13. The method of claim 12 wherein said flange includes a plurality of radially extending slots, and wherein said last-mentioned step comprises affixing to the heat exchanger plate a plurality of clips mounted respectively within said slots.

* * * * *

UNITED STATES PATENT AND TRADEMARK OFFICE

CERTIFICATE OF CORRECTION

PATENT NO. : 4,291,752

DATED : September 29, 1981

INVENTOR(S) : David G. Bridgnell

It is certified that error appears in the above—identified patent and that said Letters Patent is hereby corrected as shown below:

On the cover sheet, the following entries should be added:

Assignee: The Garrett Corporation

Attorney, Agent or Firm: Henry M. Bissell, Albert J. Miller, Joel D. Talcott

Signed and Sealed this

*Thirtieth* Day of *March 1982*

[SEAL]

*Attest:*

GERALD J. MOSSINGHOFF

*Attesting Officer*

*Commissioner of Patents and Trademarks*